US006647936B2

(12) United States Patent
Lewis

(10) Patent No.: US 6,647,936 B2
(45) Date of Patent: Nov. 18, 2003

(54) VCT LOCK PIN HAVING A TORTUOUS PATH PROVIDING A HYDRAULIC DELAY

(75) Inventor: Jeff Lewis, Freeville, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/294,277

(22) Filed: Nov. 14, 2002

(65) Prior Publication Data

US 2003/0196623 A1 Oct. 23, 2003

Related U.S. Application Data

(60) Provisional application No. 60/374,331, filed on Apr. 22, 2002.

(51) Int. Cl.[7] ..... F01L 1/34

(52) U.S. Cl. ..... 123/90.17; 123/90.15; 123/90.27; 123/90.31; 464/160

(58) Field of Search ..... 123/90.15, 90.17, 123/90.27, 90.31; 251/12, 14; 464/1, 2, 160

(56) References Cited

U.S. PATENT DOCUMENTS 5,184,581 A * 2/1993 Aoyama et al. ..... 123/90.31
5,797,361 A * 8/1998 Mikame et al. ..... 123/90.17
5,836,275 A 11/1998 Sato ..... 123/90.17
5,901,674 A 5/1999 Fujiwaki ..... 123/90.17
5,927,239 A 7/1999 Kohrs et al. ..... 123/90.17
5,941,203 A 8/1999 Sato ..... 123/90.17
5,979,380 A 11/1999 Nakadouzono et al. .. 123/90.17
6,006,708 A 12/1999 Ken et al. ..... 123/90.17
6,006,709 A 12/1999 Ushida ..... 123/90.17
6,035,819 A 3/2000 Nakayoshi et al. ..... 123/90.17
6,105,543 A 8/2000 Ogawa ..... 123/90.17
6,250,265 B1 * 6/2001 Simpson ..... 123/90.17
6,497,208 B2 * 12/2002 Miyasaka ..... 123/90.17

* cited by examiner

*Primary Examiner*—Thomas Denion
*Assistant Examiner*—Ching Chang
(74) *Attorney, Agent, or Firm*—Brown & Michaels, PC; Greg Dziegielewski

(57) ABSTRACT

A variable cam timing phaser having a tortuous path from the supply of pressurized oil to the tapered recess into which the locking pin fits, that introduces a delay between when the engine starts and when the locking pin moves to an unlocked position. The tortuous path restricts fluid flow, preventing the locking pin from unlocking during engine start-up with the initial oil pressurization, prior to the variable cam timing phaser having sufficient oil to operate. The delay ensures that the chambers of the variable cam timing phaser have time to fill with operating fluid before the phaser is unlocked.

3 Claims, 1 Drawing Sheet

VCT LOCK PIN HAVING A TORTUOUS PATH PROVIDING A HYDRAULIC DELAY

REFERENCE TO RELATED APPLICATIONS

This application claims an invention which was disclosed in Provisional Application No. 60/374,331, filed Apr. 22, 2002, entitled "VCT Locking Pin Tortuous Path". The benefit under 35 USC §119(e) of the United States provisional application is hereby claimed, and the aforementioned application is hereby incorporated herein by reference.

BACKGROUND OF THE INVENTION

1. Field of the Invention

The invention is related to a hydraulic control system for controlling the operation of a variable camshaft timing (VCT) system. More specifically, the present invention relates to a control system, which utilizes a tortuous or restricted path to delay the release of the locking pin.

2. Description of Related Art

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor with one or more vanes, mounted to the end of the camshaft, surrounded by a housing with the vane chambers into which the vanes fit. It is possible to have the vanes mounted to the rotor, and the chambers in the stator, as well. The housing'outer circumference forms the sprocket, pulley or gear accepting drive, usually from the camshaft (typically a chain, belt or gears). The phaser operates using engine oil as the working fluid, introduced into the oil chambers on either side of vanes, so as to rotate the camshaft angularly relative to the drive from the crankshaft.

Since the phasers cannot be perfectly sealed they are subject to oil loss through leakage. During normal engine operation, the oil pressure and flow generated by the engine oil pump is generally sufficient to keep the phaser full of oil and fully functional. However, when the engine is shut down, the oil can leak from the VCT mechanism. During engine start conditions, before the engine oil pump generates oil pressure, the lack of controlling oil pressure may allow the phaser to oscillate excessively due to lack of oil, producing noise and possibly damaging the mechanism. Additionally, it is desirable to have the phaser locked in a particular position while the engine is attempting to start.

One solution employed in prior art phasers is to introduce a locking pin that will lock the phaser in a specific phase angle position relative to the crankshaft when insufficient oil exists in the chambers. These locking pins are typically spring-loaded to engage and are released using engine oil pressure. Therefore, when the engine is shut down and engine oil pressure reaches some predetermined low value the spring-loaded pin will engage and lock the phaser. During engine start, the pin remains engaged until the engine oil pump generates enough pressure to release the pin.

A second example of prior art locking pins is U.S. Pat. No. 5,836,275, which discloses a locking pin having a "canceling means" to prevent retraction of the locking pin until the chambers are filled with oil. The "canceling means" being a small hole at the bottom end of a hole located in the housing that extends inward in the radial direction.

Another example is U.S. Pat. No. 5,901,674, which shows a lock pin having a separate unlock line and valve. The locking pin restricts the rotation of the inner rotor and the outer rotor until after the engine has been started. During this time period, a sufficient oil supply is being built up in the advancing and delaying chamber to unlock the locking pin.

U.S. Pat. No. 5,927,239 discloses a locking pin with a flow restrictor upstream of a coupling member. The flow restrictor being a steel ring which is secured to the housing, having an inner ring surrounding a slide ring. The gap remaining between the inner circumference of the steel ring and the slide ring allows a hydraulic medium to travel through. Due to this restriction, a small delay is introduced in releasing the locking pin and is specifically viewed as a disadvantage by the inventors of U.S. Pat. No. 5,927,239. The disadvantage of the delay is considered to be offset by the elimination of the rattling noises that emanate from the locking piston.

U.S. Pat. No. 5,941,203 shows a lock pin that is shaped to allow the phaser to rotate faster as the pin retracts. The shape of the locking pin consisting a head portion that is curved or spherical and a skirted portion. The head portion fits into a hole in the internal rotor to regulate the relative rotations of the internal and external rotor. As more working oil is fed into the hole, the locking pin is pushed out until it no longer regulates the rotations of the internal and external rotor.

Another example is U.S. Pat. No. 5,979,380, which discloses a vane phaser with a locking pin. An application of pressure retracts the pin. The locking pin mechanism is disposed between the rotor and the housing member, including a receiving hole, formed on the outer circumferential portion of the rotor, a canceling hole, which is formed on the inner circumferential portion of the housing member, so as to be able to align with the receiving hole, and a stepped locking pin which is slidably fitted into the canceling hole. When pressure of the fluid discharged is high enough, the changeover valve is changed to the first position, the pressurized fluid is supplied to the first chamber and the receiving hole simultaneously, and the locking pin is then pushed out the hole to allow rotation to occur.

U.S. Pat. No. 6,006,708 discloses a lock pin retraction that takes place due to oil passages in both the advance and retard chambers. The retraction is delayed by the ECU during engine startup to avoid problems associated with low oil pressure.

U.S. Pat. No. 6,006,709 shows a lock pin that locks a phaser under low oil conditions. The lock pin retraction is delayed until there is sufficient oil in the advance chamber to avoid a rattling on startup.

Another example is U.S. Pat. No. 6,024,061 discloses lock pin that is removed when full retard pressure is available to hold the phaser in a retarded condition before operation. This is achieved by having the ECU execute a delay on startup before applying retard pressure to the phaser so as to allow oil pressure to build up.

U.S. Pat. No. 6,035,819 discloses a phaser that is switched to the most advanced position as the engine stalls and then moves to a locked position as the engine starts. Without adequate pressure, the locking pin stays locked and holds the phaser in the middle of the pressure chamber. The phaser is unlocked after the engine is started. A slight delay is experienced since the vane is in the middle of the pressure chamber.

Lastly, U.S. Pat. No. 6,105,543 shows a spherical end to a locking pin to facilitate withdrawal as pressure is built up.

A drawback of these current locking pins is that they unlock with the initial oil pressurization, prior to the phaser having sufficient oil to operate.

Therefore, a locking mechanism is needed that causes the locking pin to be released after a delay between engine startup and when the locking pin is disengaged from the rotor.

SUMMARY OF THE INVENTION

The invention comprises a variable cam timing phaser having a tortuous path from the supply of pressurized oil to the tapered recess into which the locking pin fits, that introduces a delay between when the engine starts and when the locking pin moves to an unlocked position. The tortuous path restricts fluid flow, preventing the locking pin from unlocking during engine start-up with the initial oil pressurization, prior to the variable cam timing phaser having sufficient oil to operate. The delay ensures that the chambers of the variable cam timing phaser have time to fill with operating fluid before the phaser is unlocked.

DETAILED DESCRIPTION OF THE INVENTION

Figure 1:
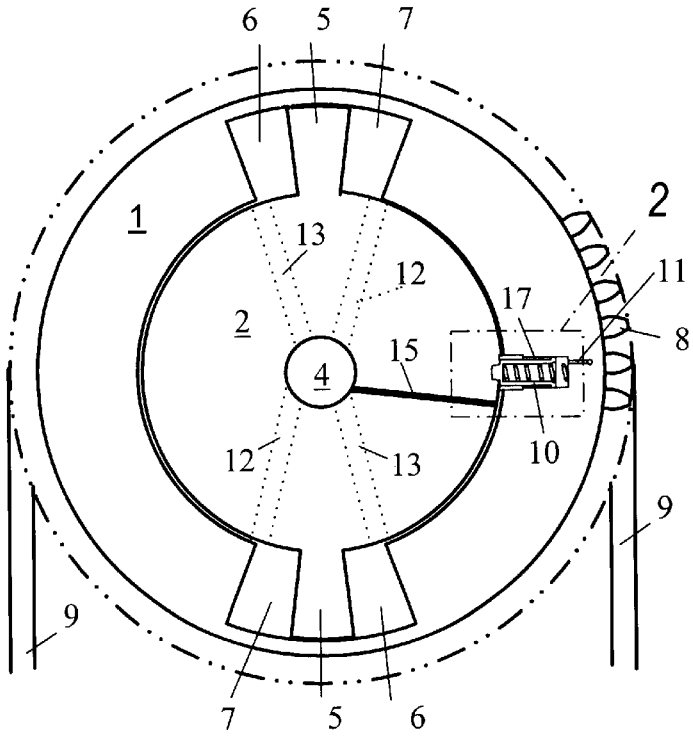
FIG. 1 shows a front view of a VCT phaser incorporating the invention.

Referring to FIG. 1, a vane-type VCT phaser comprises a housing (1), the outside of which has sprocket teeth (8) which mesh with and are driven by timing chain (9). Inside the housing (1) are fluid chambers (6) and (7). Coaxially within the housing (1), free to rotate relative to the housing, is a rotor (2) with vanes (5) which fit between the chambers (6) and (7), and a central control valve (4) which routes pressurized oil via passages (12) and (13) to chambers (6) and (7), respectively. Pressurized oil introduced by valve (4) into passages (12) will push vanes (5) counterclockwise relative to the housing (1), forcing oil out of chambers (6) into passages (13) and into valve (4).

It will be recognized by one skilled in the art that this description is common to vane phasers in general, and the specific arrangement of vanes, chambers, passages and valves shown in FIG. 1 may be varied within the teachings of the invention. For example, the number of vanes and their location can be changed—some phasers have only a single vane, others as many as a dozen, and the vanes might be located on the housing and reciprocate within chambers on the rotor. The housing might be driven by a chain or belt or gears, and the outside of the housing might be sprocket teeth as shown, or a pulley for a belt, or gears.

Figure 2A:
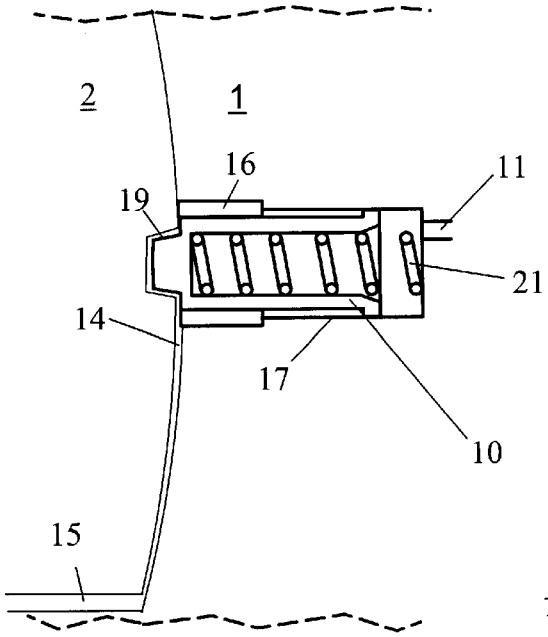
FIGS. 2*a* & 2*b* shows engaged and disengaged positions of the present invention respectively, in detail from within box 2 in FIG. 1.
Figure 2B:
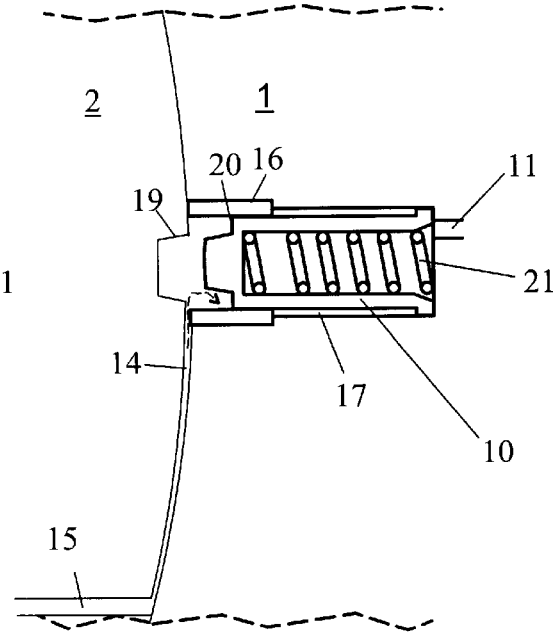

Referring to FIG. 1 and the detail of FIG. 2*a*, in the phaser of the invention, a locking pin (10) slides in a bore (17) in the housing (1), and is pressed by a spring (21) into a recess (19) in the rotor (2) to lock the rotor (2) and housing (1) into a fixed rotational position. A vent (11) allows any oil, which might leak past the piston (10) to be discharged. A bushing (16) may be provided in the bore, surrounding at least the inner end (20) of the locking pin, to provide a better seal.

A tortuous fluid passage (14) feeds pressurized oil from a supply of pressurized oil (15) into the recess (19). The tortuous path (14) may be a worm trail, a small hole, or a restriction present anywhere along the path from the supply of pressurized oil to the locking pin. Due to the tortuous path (14) in which the oil travels before it arrives at the recess (19), sufficient pressure to unlock the locking pin (10) is not available until the operating chambers of the VCT are mostly filled with oil.

Thus, at engine start-up, oil has to travel the tortuous fluid passage, adding time delay before arriving at the recess, which thus cannot push the locking pin back against the force of the spring until the supply oil pressure has risen to a level in which there is sufficient oil in the passages to fully fill the chambers of the phaser.

When the engine is shut down, the pressure in the recess and the passage drops below the required pressure to hold the pin in the bore against the force of the spring, and the locking pin moves toward the rotor. When the pin and the recess come into alignment the pin drops into the recess locking the rotor and housing.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable camshaft timing phaser for an internal combustion engine having at least one camshaft comprising:

a) a housing having an outer circumference for accepting drive force;

b) a rotor for connection to a camshaft, coaxially located within the housing, capable of rotation to shift the relative angular position of the housing and the rotor, having a tapered recess in an outer circumference;

c) a locking pin slidably located in a radial bore in the housing adjacent the rotor, comprising a body having a diameter adapted to a fluid-tight fit in the radial bore, and an inner end toward the rotor with a tapered portion adapted to fit in the tapered recess, the locking pin being radially moveable in the bore from a locked position in which the tapered end fits into the tapered recess, locking the relative angular position of the housing and the rotor, to an unlocked position, in which the tapered end does not engage the rotor;

d) a spring located in the radial bore opposite the inner end of the locking pin, urging the locking pin radially inward toward the locked position; and e) a tortuous fluid passage coupling the tapered recess to a supply of pressurized oil, such that a time delay is introduced in moving the tapered end of the locking pin from the tapered recess in the rotor.

2. The variable camshaft timing phaser of claim 1, further comprising a bushing in the bore surrounding at least the inner end of the locking pin.

3. The variable camshaft timing phaser of claim 1, wherein the tortuous fluid passage is a worm trail.

* * * * *